US005257699A

United States Patent [19]

Fricker et al.

[11] Patent Number: 5,257,699

[45] Date of Patent: Nov. 2, 1993

[54] DISC SCREEN CONSTRUCTION

[75] Inventors: John W. Fricker, Cincinnati, Ohio; James C. Wilcox, Hattiesburg, Miss.

[73] Assignee: Mill Services and Manufacturing, Inc., Hattiesburg, Miss.

[21] Appl. No.: 792,267

[22] Filed: Nov. 18, 1991

[51] Int. Cl.[5] ..... B07C 9/00

[52] U.S. Cl. ..... 209/672; 209/624; 209/392; 492/49

[58] Field of Search ..... 209/672, 671, 667, 624, 209/392, 365; 29/130, 124, 125; 403/274; 210/331, 346

[56] References Cited

U.S. PATENT DOCUMENTS

| | | | |
|---|---|---|---|
| 1,613,032 | 1/1927 | Goudy . | |
| 1,679,593 | 8/1928 | Williamson et al. | 209/672 |
| 1,960,955 | 5/1934 | Recker . | |
| 2,092,421 | 9/1937 | Morgan . | |
| 3,077,928 | 2/1963 | Nihlen et al. . | |
| 3,258,954 | 7/1966 | Dennis . | |
| 3,707,133 | 12/1972 | Myer . | |
| 3,724,537 | 9/1974 | Johnson . | |
| 3,834,212 | 9/1974 | Roper | 72/354 |
| 4,037,723 | 7/1977 | Wahl et al. | 209/361 X |
| 4,239,119 | 12/1980 | Kroell | 209/672 |
| 4,267,753 | 5/1981 | Bennett | 83/124 |
| 4,301,930 | 11/1981 | Smith | 209/671 |
| 4,376,042 | 3/1983 | Brown | 209/234 |
| 4,377,474 | 3/1983 | Lindberg | 209/672 X |
| 4,452,694 | 6/1984 | Christensen et al. | 209/672 |
| 4,538,734 | 9/1985 | Gill | 209/668 |
| 4,579,652 | 4/1986 | Bielagus | 209/271 |
| 4,653,648 | 3/1987 | Bielagus | 209/672 |
| 4,658,964 | 9/1987 | Williams | 209/672 X |
| 4,658,965 | 4/1987 | Smith | 209/672 |
| 4,703,860 | 11/1987 | Gobel et al. | 209/672 |
| 4,741,444 | 5/1987 | Bielagus | 209/672 |
| 4,755,286 | 7/1987 | Bielagus | 209/672 X |
| 4,774,000 | 9/1988 | Kawai et al. | 210/346 X |
| 4,795,036 | 1/1989 | Williams | 209/672 X |

FOREIGN PATENT DOCUMENTS

| | | | |
|---|---|---|---|
| 1213096 | 3/1960 | France | 210/331 |
| 312631 | 8/1971 | U.S.S.R. | 209/672 |
| 419265 | 8/1974 | U.S.S.R. | 209/672 |
| 1466810 | 3/1989 | U.S.S.R. | 209/667 |

*Primary Examiner*—David H. Bollinger

*Attorney, Agent, or Firm*—Banner, Birch, McKie & Beckett

[57] ABSTRACT

A die stamp formed disc construction including a toothed plate and a two-stepped sleeve integrally formed thereon. The sleeve has coined or stamped interior and exterior forty-five degree flats. The flats are accurately positioned so that, with the discs received through their central openings and clamped together onto the rotation shaft, the interior flat of one disc is held directly against the exterior flat of the adjacent disc thereby accurately and consistently positioning and holding the toothed plates of adjacent discs in spaced relation and preventing disc wobble.

27 Claims, 7 Drawing Sheets

DISC SCREEN CONSTRUCTION

BACKGROUND OF THE INVENTION

The present invention relates to disc screen apparatuses for sorting, by size, particulate matter such as wood chips, and the like. It more specifically relates to discs for such apparatuses and methods for forming such discs.

Disc screens have been used for many years to sort a variety of objects by size, such as wood chips, coal, coke, grain, beets, leaves, sticks and potato chips. For example, uniform high yield wood pulp requires correctly sized and composed wood chips. Examples of disc screens are those shown in the following U.S. patents. These patents and all other patents and publications mentioned herein are hereby incorporated by reference in their entireties.

| U.S. Pat. No. | Patentee |
|---|---|
| 4,037,723 | Wahl et al. |
| 4,239,119 | Kroell |
| 4,301,930 | Smith |
| 4,376,042 | Brown |
| 4,377,474 | Lindberg |
| 4,452,694 | Christensen et al. |
| 4,538,734 | Gill |
| 4,579,652 | Bielagus |
| 4,653,648 | Bielagus |
| 4,658,964 | Williams |
| 4,658,965 | Smith |
| 4,703,860 | Gobel et al. |
| 4,741,444 | Bielagus |
| 4,755,286 | Bielagus |
| 4,795,036 | Williams |

Generally speaking, these disc screens include a frame and a plurality of rotating parallel shafts mounted within the frame. Each of the shafts has a plurality of spaced apart discs mounted thereon. The discs on adjacent shafts intermesh and rotate side-by-side with a fixed critical distance between the intermeshed discs. These disc screens typically have an entrance end perpendicular to the longitudinal axes of the shafts. Opposite the entrance end is an exit end which is adjacent to a discharge port. Each shaft rotates in a downstream direction to transport matter along the discs from the entrance end to the exit end.

In operation, the particulate matter to be sorted is dropped from above the disc screen along the entrance end. The downstream shaft rotation carries the larger pieces of particulate matter across the upper surface of the screen to the discharge port. The smaller size particulate matter falls due to gravity through the critical fixed distance spaces between the intermeshing discs for collection below the disc screen. Generally, the shafts of the disc screens are coplanar and rotate in a horizontal plane.

Some devices have utilized the disc screen in an inclined position. For example, if the entrance end is at a higher level, gravity assists in transporting the larger particles over the upper surface of the disc screen. Other disc screen arrangements have linked inclined and horizontal disc screen sections, with a continuous path of travel along the upper surface of the linked sections.

The critical spacing between the intermeshing discs depends upon the disc spacing along adjacent shafts. Various methods have been used to maintain the required disc spacing on a given shaft. Many devices utilize spacers, such as washers, between adjacent plate-like disc. Close axial tolerances must be maintained on both spacers and discs to minimize the cumulative error over the length of a shaft. Close tolerance requirements, however, increase the cost of such assemblies.

Other devices use discs having hubs projecting outwardly from one or both sides of the disc which butt against the adjacent hub or disc. Some hubbed discs are die cast and susceptible to fracture from porosity and other material impurities. Die cast discs are generally thicker, heavier to handle, and expensive due to the increased material required, however. Many of these earlier devices have used bearings having cast bearing housings to mount the rotating shaft to the frame. These cast bearing housings usually have oversized mounting bolt holes to facilitate shaft alignment. Vibrations encountered during operation can loosen the mounting bolts, allowing the bearing housing to shift. Thus the critical spacing is not maintained.

For shaft assemblies having a plurality of spaced apart discs mounted upon a cylindrical shaft, there is an undesirable tendency for the discs to rotate relative to the shaft and/or relative to each other. This undesirable rotation impedes the flow of the particulate matter across the screen. A variety of notch and key methods have been used to prevent this rotation. Examples thereof are shown in the previously-listed '723 patent to Wahl, the '734 patent to Gill and the '119 patent to Kroell. Another method has been to weld the discs to the shaft to prevent the rotation and maintain axial alignment. The welding of the discs is a time consuming process, however, due to the close tolerances often involved and may also heat warp the discs. A prior art disc and disc screen assembly which remedies many of the problems has been commercially available from Mill Services and Manufacturing, Inc. of Hattiesburg, Miss. under the trademark "SoloDisc," which can be used in a flat screen or a V-screen replacement shaft assembly. This prior art disc screen assembly allows the discs to be readily fitted upon a shaft during initial assembly, retrofitting and replacement. The shaft assembly has a minimal number of parts and has minimal disc wobble resulting. This prior art system is illustrated in FIGS. 1–5 generally at 100 and is described below.

Referring to FIGS. 1 and 2 it is seen that a shaft 102 is driven by a belt drive (a "Gates Poly Chain GT" drive—see e.g., U.S. Pat. No. 4,605,389) extending over a sheave 104. The belt drive thereby directly drives the entire shaft (a "live" shaft) through a bearing 106 and which in turn drives a pipe roll 108. Thus the pipe roll 108 is secured to and rotatable with the shaft. A plurality of individual stepped discs 110 are slipped into place on the roll and held therein by the locking slots, by the stepped relation of the discs, and by the compression lock nut 112 securable thereto. Also illustrated in the FIG. 2 are the male fixed end cap 114, the female compression ring 116, the lock washer 117 and the shaft seal 118 of shaft assembly 100.

The prior art disc 110 shown in isolation FIGS. 3–5, comprises a disc plate 122 having teeth 124 about its outer perimeter and a double stepped spacing and nesting sleeve shown generally at 126 integrally formed with the plate. The first step 128 is sized diametrically to slidably receive the tubular shaft (108). The second step 130 interconnects the first step 128 with the plate 122 and is diametrically sized to slidably receive the first step of a preceding disc. Thus, the adjacent precedingly and subsequently assembled discs are nested together by their overlapping steps. This sleeve 126 spaces the discs 110 at the desired distance.

A stop 132 and a stop engaging surface 134 are provided on the two-stepped sleeve 126. The stop 132 is formed as a shoulder defined by the outer radius of the bend in the sleeve 126 connecting the second step 130 with the disc plate 122. The stop engaging surface is shown by the shoulder stop 132 located at the outer periphery of the diametrical transition between the first and second steps 128, 130. When assembled, the shoulder of one disc engages the shoulder stop of the adjacent disc to maintain a desired spacing between adjacent discs. Separate spacers are thus not required to maintain disc spacing. The desired spacing is determined from the disc plate thickness and the maximum size of acceptable particles. In other words, the critical space equals one-half the difference between the desired spacing and the disc thickness. Thus, the axial length of the first step on a preceding disc should be long enough to extend under the second step but not so long as to interfere with the first step of the next disc.

After the discs have been assembled on the shaft, the lock nut 112 is tightened, forcing the compression collar inward and the shoulders of the discs into engagement with the shoulder stops of the preceding discs. The lock washer 117 prevents further rotation of the lock nut 112 and maintains the axial alignment of the discs. Thus no welding, which is not only time consuming but may also heat warp the disc, is needed. Each of the discs is provided with an inwardly projecting key or dimple 140 on the first step 128 of the disc which then slides onto a longitudinal groove on the outer surface of the tubular shaft thereby preventing relative rotation of the discs.

These discs were manufactured from ductile steel using a three-step draw die. At the first draw die step the center opening was punched through the disc, a slight draw of around 7½ millimeters for the double stepped sleeve was formed and the outer diameter of the disc was punched. The second die punched the draw to form the double stepped sleeve. A third punch formed the teeth on the outer diameter of the disc. These teeth were chrome plated in a subsequent operation. In a fourth forming step a slide punch placed the anti-rotation dimple or key in the first step of the sleeve. The disc assemblies were assembled with the teeth on adjacent discs staggered to assist in pulling apart the mat of particulate matter conveyed thereon. The dimple was thus located positively or fixed relative to the teeth. (Examples of prior art die stamping procedures for other articles are disclosed in U.S. Pat. Nos. 3,707,133 and 3,834,212.)

Thus with the discs slid into place on the shaft and held together by the end clamping means, the stop of one disc is adjacent the shoulder stop of the adjacent disc. Since both of these surfaces are curved rounded surfaces, as best shown in FIG. 5, the contact between the shoulder and the stop, when viewed in cross-section, is essentially only a point contact, or when viewed in three dimensions is a circle line contact, the line having a maximum width of generally only one thirty-second of an inch. This provides for only a ball joint type of coacting relationship, allowing one surface to roll against the other, that is, allowing the discs to wobble.

Although as a practical matter this prior art screen functioned effectively, commercially they were not as successful as desired due to this wobble. The customer requires uniform spacing with extremely tight tolerances, and IFOs having an accuracy of twenty thousandths of an inch are preferred. No method, even the "SoloDisc", was known for consistently providing these accurate IFOs in a system without any undesirable wobbling of the disc.

In fact since such a system was thought not possible, the trend in sorting machines has been away from disc screens and to spiral and diamond roll-type screens. Examples of such are the "DynaGage Bar Screen" available from Rader Companies, which is a division of Beloit Corporation and has a headquarters in Portland, Oreg. It includes z gauge bars. The slots between the bars establish the maximum particle thickness that will pass through the screen. When activated the eccentricity of the shafts causes each deck to oscillate independently. Another recent design also available from Rader Companies is the "Raderwave Fines Screen", which has a series of parallel shafts located beneath a flexible perforated screen deck. A wave-like motion is created on the material on the screen when the shafts rotate. The pins and chips are thereby apparently suspended, the fines (undersized chips) migrate through the perforations and acceptable fiber travels across the screens.

Another example is the "ChipManager PST" available from Evergreen Engineering, Inc. of Eugene, Oreg. and disclosed in U.S. Pat. No. 4,376,042. A further system also available from Evergreen Engineering is their "ChipManager VSF". It uses a small horizontal disc screen head of an existing system to thereby split the infeed mass and more thoroughly remove fines and overthicks.

SUMMARY OF THE INVENTION

Accordingly it is a principal object of the present invention to provide an improved disc screen assembly which is easy to manufacture, assemble and repair.

Another object of the present invention is to provide an improved disc construction which is easy to manufacture and which reliably and consistently maintains an accurate spacing between adjacent discs and which prevents disc wobble.

A further object of the present invention is to provide a novel method of manufacturing these improved discs.

Directed to achieving these objects, an improved disc construction is herein disclosed. It is formed as a one-piece metal stamping having perimeter teeth and a central opening through which it can be assembled onto shafts at exact predetermined spacing. These shaft and disc assemblies are arranged in parallel rows to make a rotating screen for sorting wood chips for the paper industry. The disc includes a plate having a toothed perimeter and a sleeve integrally formed with the plate and projecting out from one face thereof. The sleeve is formed as a two-stepped arrangement having an exterior stop and an interior shoulder stop, both formed as angled flat surfaces. When the sleeves are assembled onto the shaft, the stop of one sleeve engages the shoulder stop of an adjacent sleeve over a wide area and thereby accurately positions and holds the plates at the desired spaced relation. There are generally between one hundred and one hundred and forty-three, or typically one hundred and sixteen, discs per shaft and generally between five and twenty-two, or typically sixteen, shafts per screen.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS

Figure 1:
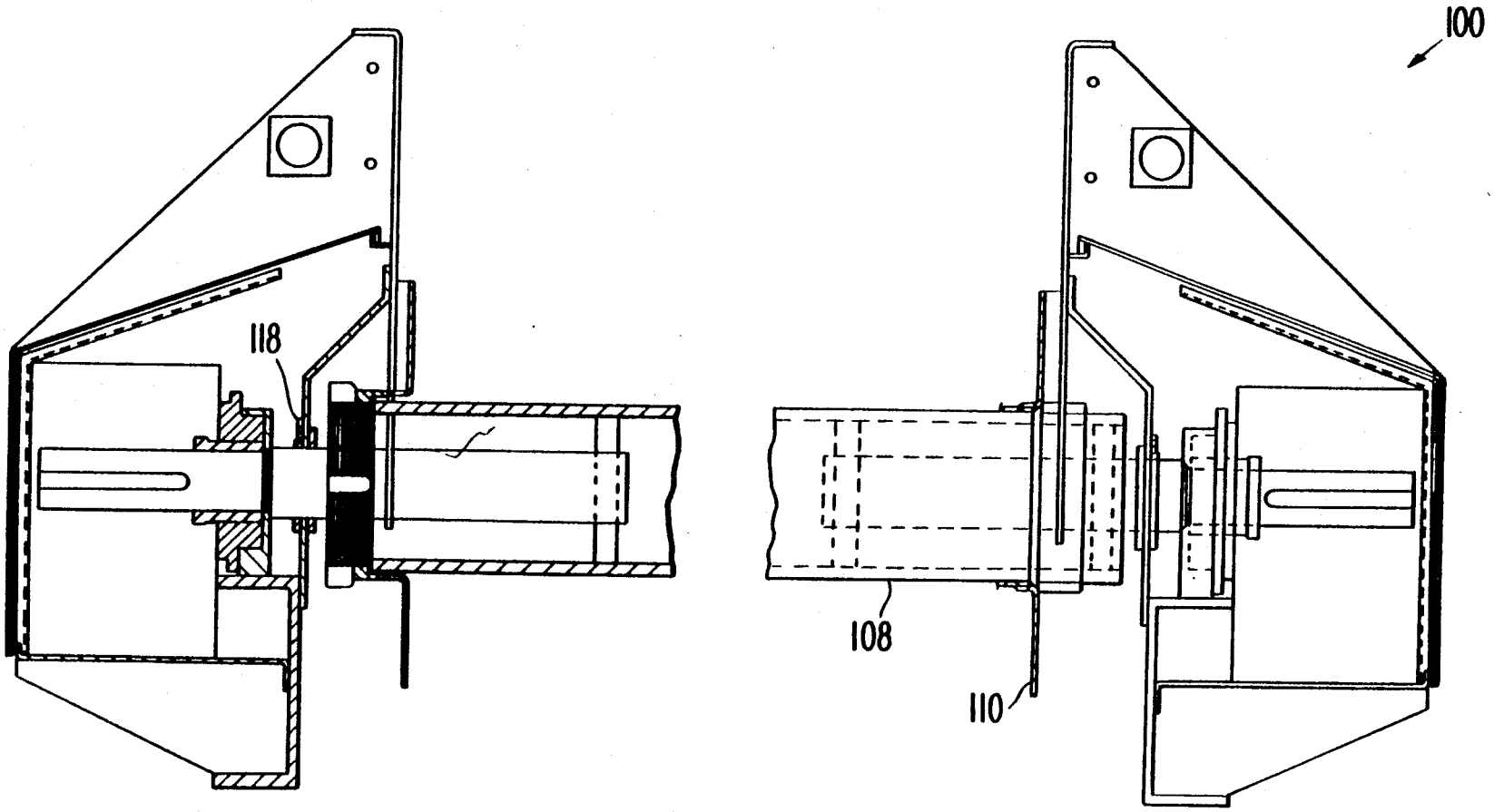
FIG. 1 (PRIOR ART)
FIG. 1 is an elevational view of a prior art disc screen shaft assembly, with a central portion thereof broken away for illustrative purpose.
Figure 2:
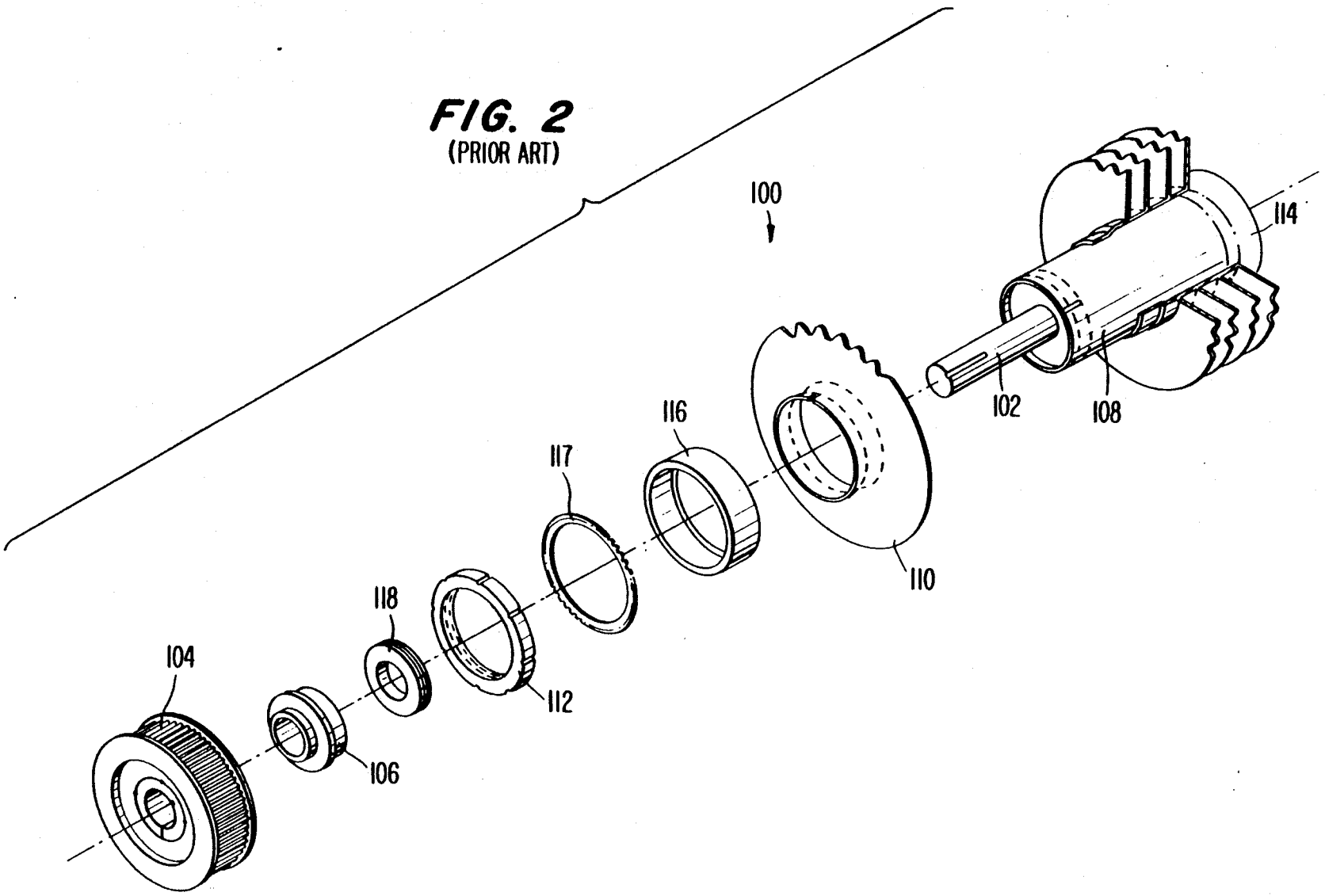
FIG. 2 (PRIOR ART)
FIG. 2 is an exploded perspective view of the shaft assembly in FIG. 1.
Figure 3:
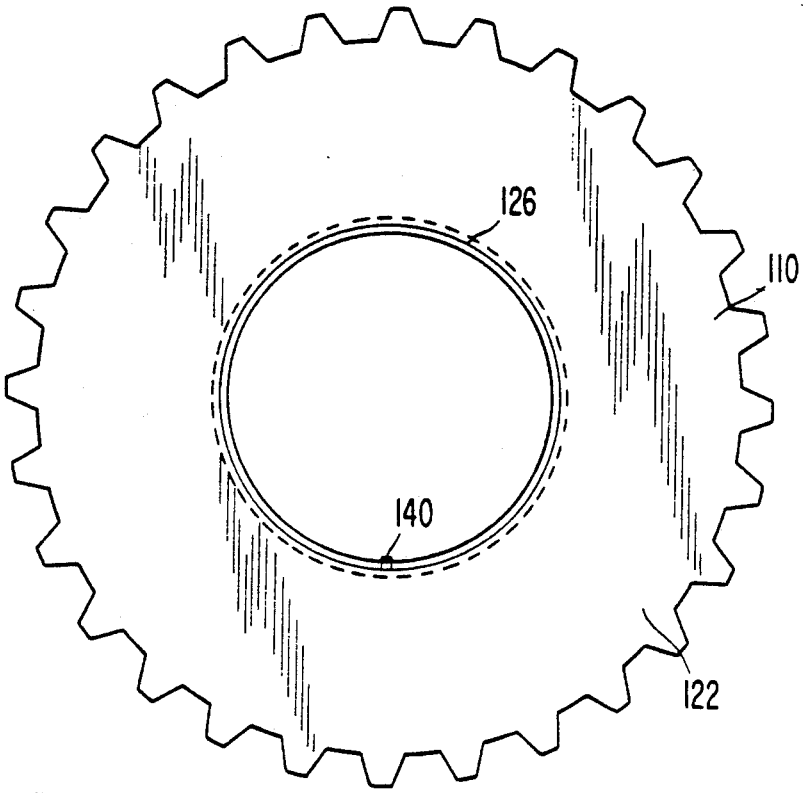
FIG. 3 (PRIOR ART)
FIG. 3 is an elevational view of the prior art disc of the shaft assembly of FIG. 1 and illustrated in isolation.
Figure 4:
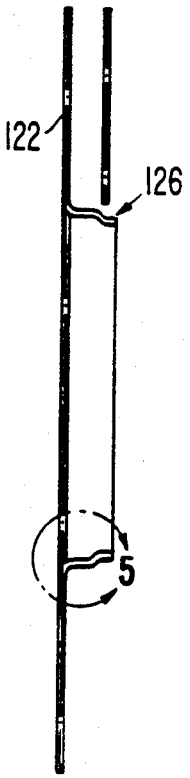
FIG. 4 (PRIOR ART)
FIG. 4 is a side elevational view of the disc of FIG. 3.
Figure 5:
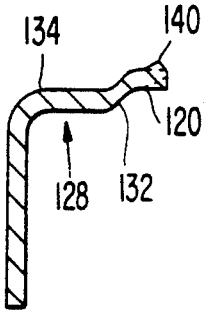
FIG. 5 (PRIOR ART)
FIG. 5 is an enlarged view taken on circle 5 of FIG. 4.
Figure 6:
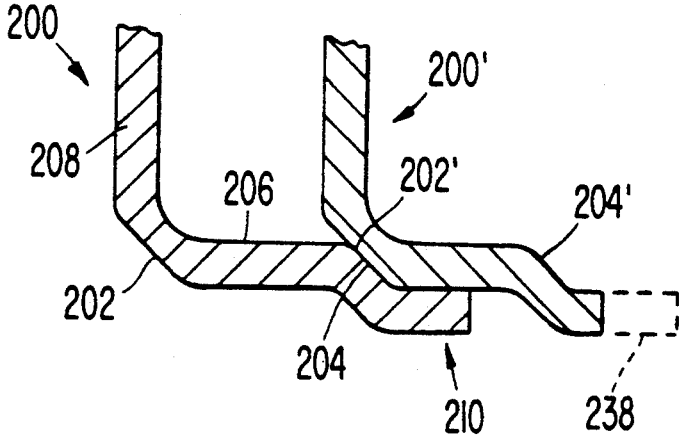
FIG. 6 is a sectional view, similar to FIG. 5, of a pair of discs of the present invention illustrated in an assembled position; these discs are in other non-illustrated aspects the same as that shown in FIG. 3.

The disc screen assembly of the present invention differs only in a few small, but extremely important, aspects over that illustrated in FIGS. 1–5. These differences focus on the construction of the disc itself and primarily the two-stepped sleeve component thereof. The relevant portion of the disc construction of the present invention is shown in FIG. 6, and the invention embodied therein will become apparent when compared to the stepped-sleeve arrangement of the prior art illustrated in FIG. 5. It is seen in the disc 200 in FIG. 6 that a pair of parallel flat surfaces 202, 204 are formed disposed at angles of forty-five degrees relative to the center line of the disc, or when mounted on the shaft to the center line of the shaft. The inner flat 202 forms a shoulder at the transition between the first inner step 206 of the disc and the toothed disc plate 208. The exterior flat 204 forms a stop at the transition between the inner step 206 and the outer step 210. Each of these flats is between 3/16 and ¼ inch, or approximately one-quarter inch, wide and defines a frusto-conical surface when viewed in three dimensions. Thus, with the discs 200, 200' slid into place on the shaft and held thereon by the first step, the top side of the outer step 208 slides under the disc plate 210' of the adjacent disc 200' such that the shoulder 202' of one disc 200' abuts against the stop 204 of the adjacent disk 200. These large flat surfaces provide a wide area of contact. When the discs are clamped together on the shaft and the shaft is rotated in a screening operation, the discs accordingly do not wobble due to this wide flat contact. The flats 202, 204 are arranged at forty-five degrees relative to the center line of the rotating shaft to provide the maximum surface contact area between adjacent discs. Other angles in a mating relationship are also within the scope of the present invention.

Figure 9:
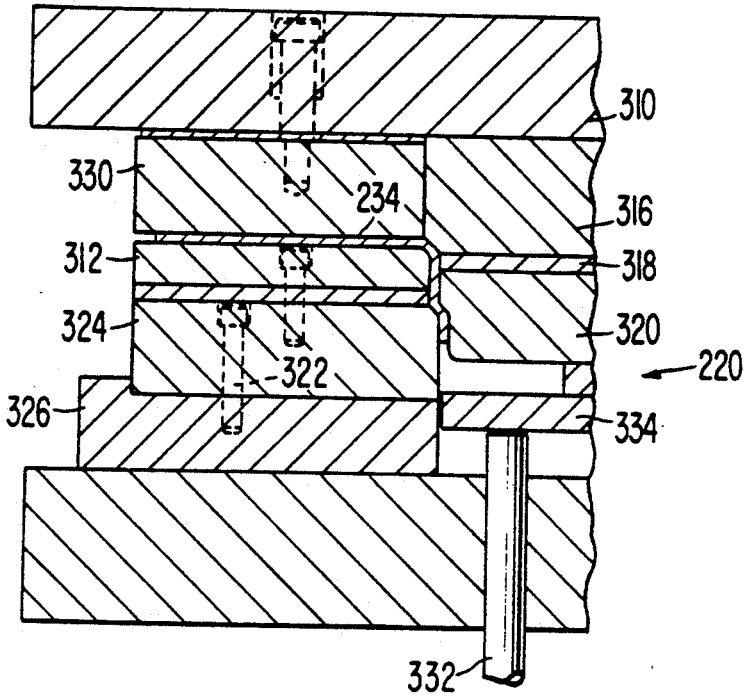
FIG. 9 is a sectional fragmentary view of a third die of the present invention illustrating the coining and extruding step.

Both of these flat areas, that is, the shoulder 202 and the stop 204 of each disc, are formed simultaneously with a coining die, as shown in FIG. 9 at 220. The preferred material for these discs 200 is a cold or hot rolled sheet of A1008, A1006 or A1003 steel, 3/16ths of an inch thick and in a 20½ by 20½ inch square. A uniform metal thickness in any one lot is desirable to minimize variations. Where there is a wide range in thickness variations, however, the parts should be sorted in groups and these variations adjusted for during the coining operation.

The process for forming the disc is described below, and details of each of the dies follow this process description.

(1) The first, second and third dies 222, 224, 220 are set up for the particular spacing or IFO being produced.

Figure 7:
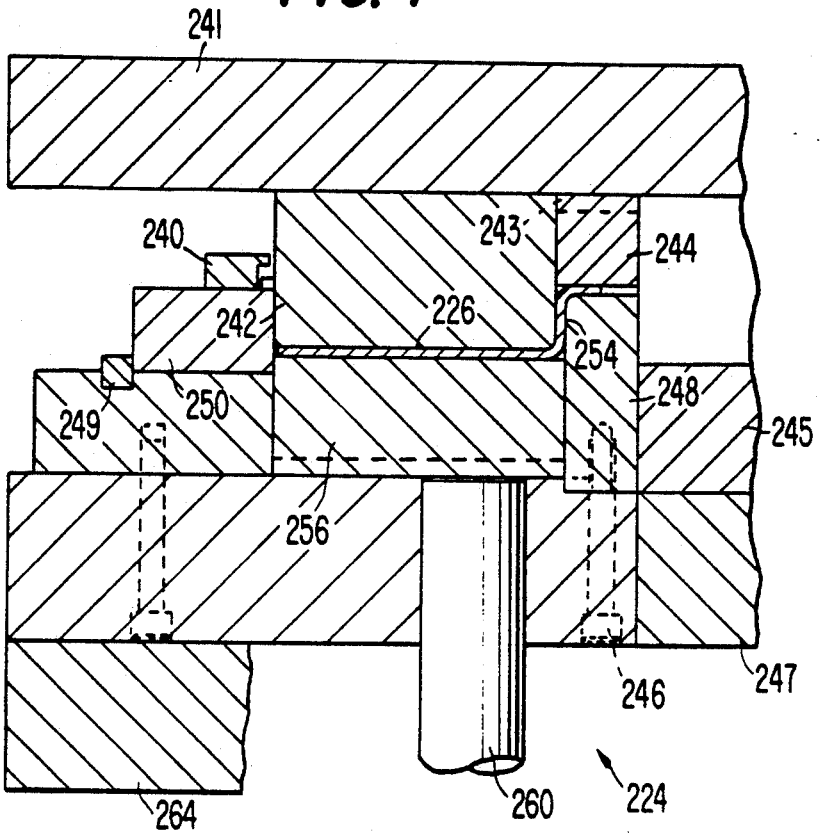
FIG. 7 is a sectional fragmentary view of a first die of the present invention illustrating the blank piercing and drawing step of the present invention for forming the disc(s) of FIG. 6.

(2) The square steel sheet 226 is place in the first die 222, which is shown in FIG. 7, where with a five-hundred ton hydraulic press with cushion, the center opening is pierced and a preliminary draw is made.

Figure 8:
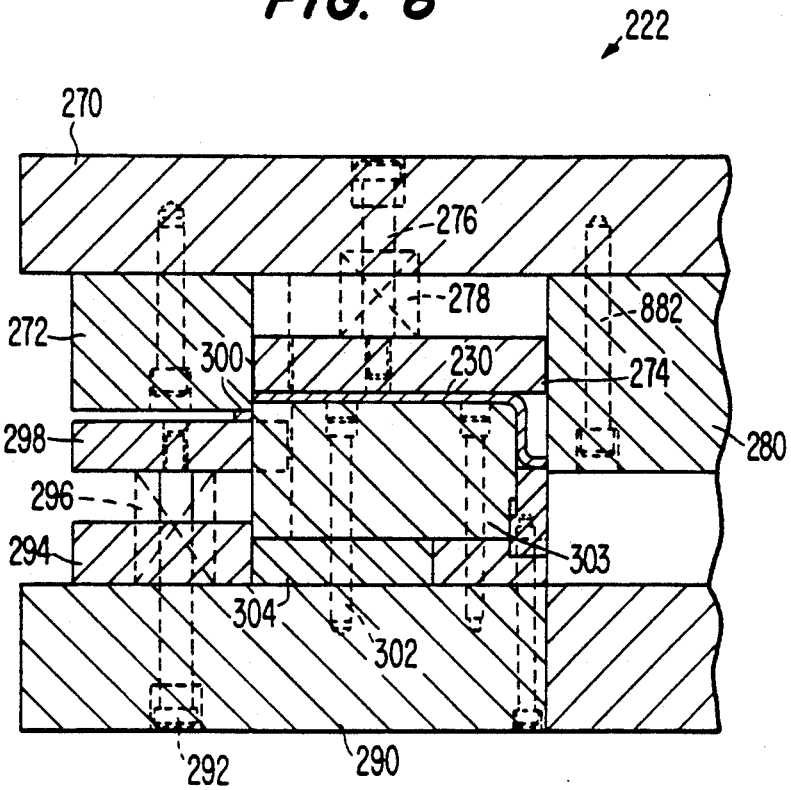
FIG. 8 is a sectional fragmentary view of a second die of the present invention illustrating the trimming and piercing step for the present disc.

(3) The part 230 is then placed in the second die 224, which is shown in FIG. 8, where with the operation of an eight-hundred ton press, the teeth are trimmed and the center is repierced.

(4) The part 234 is then placed in the third die 220, which is shown in FIG. 9, where using a five-hundred ton hydraulic press with cushion, the flats 202, 204 are coined and the part extruded. Continual inspection is needed, the outboard stop rails on each side of the die can be built up as needed and the stack height controlled by utilizing shimming stop rails and/or by varying the press tonnage.

(5) The disc par(s) is (are) mounted on a stack check fixture disposed on a large surface area and height measurements are made using an eighteen-inch digital count zero reset dial height gauge fitted with a 0.030 dial indicator. Eleven discs are stacked with their hubs upward on the check fixture and clamped snug with a spider and draw bolt. The indicator is set at zero on the top surface of the tooth on the bottom disc and the height is read on the top surface of the tooth of the uppermost disc. These readings are repeated for at least four equal places around the periphery of the disc. These readings are then averaged and divided by ten, and a stack-height tolerance per disc of only plus or minus 0.002 inch is permitted.

Figure 10:
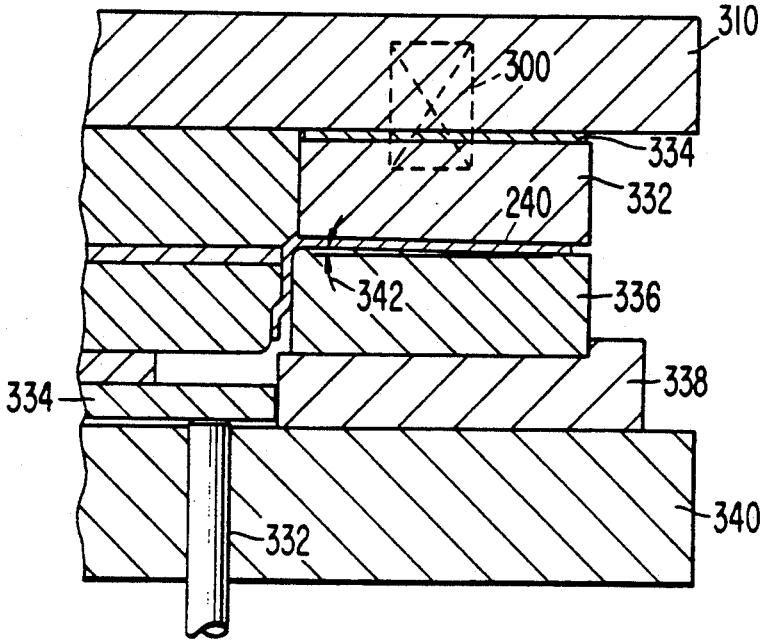
FIG. 10 is a sectional fragmentary view of the die in FIG. 9 illustrated in the flattening and resizing mode and step.

(6) The die 220 of FIG. 9 is converted to a one-degree overbend flattening mode using flattening rings, as shown in FIG. 10, and a top shim is installed to apply tonnage to the flat rather than the hub area of the disc. The part 240 is positioned in this die (modified die 220), a five-hundred ton hydraulic press with cushion is applied and the flange area is thereby flattened.

(7) The part is removed from the over-form die of FIG. 20 and is furnace carburized. Parts are stacked in the furnace, axis vertically, with spacer rings and top and bottom caps to minimize distortion and to restrict carbonaceous atmosphere to the tooth area only.

(8) The part is then induction hardened in the tooth area.

(9) The part is flattened and the hub resized in the coin die of FIG. 9 set up in the flattening mode and using a five-hundred ton hydraulic press with cushion. The disc should be flat after the hardening and finishing operations, and this is greatly dependent on the chemical and physical properties of the material; the hardness and carbon content are variables which need to be controlled. The hole is being restruck after heat treatment to round it up.

(10) The part is inspected again, similar to step (5) above.

Figure 11:
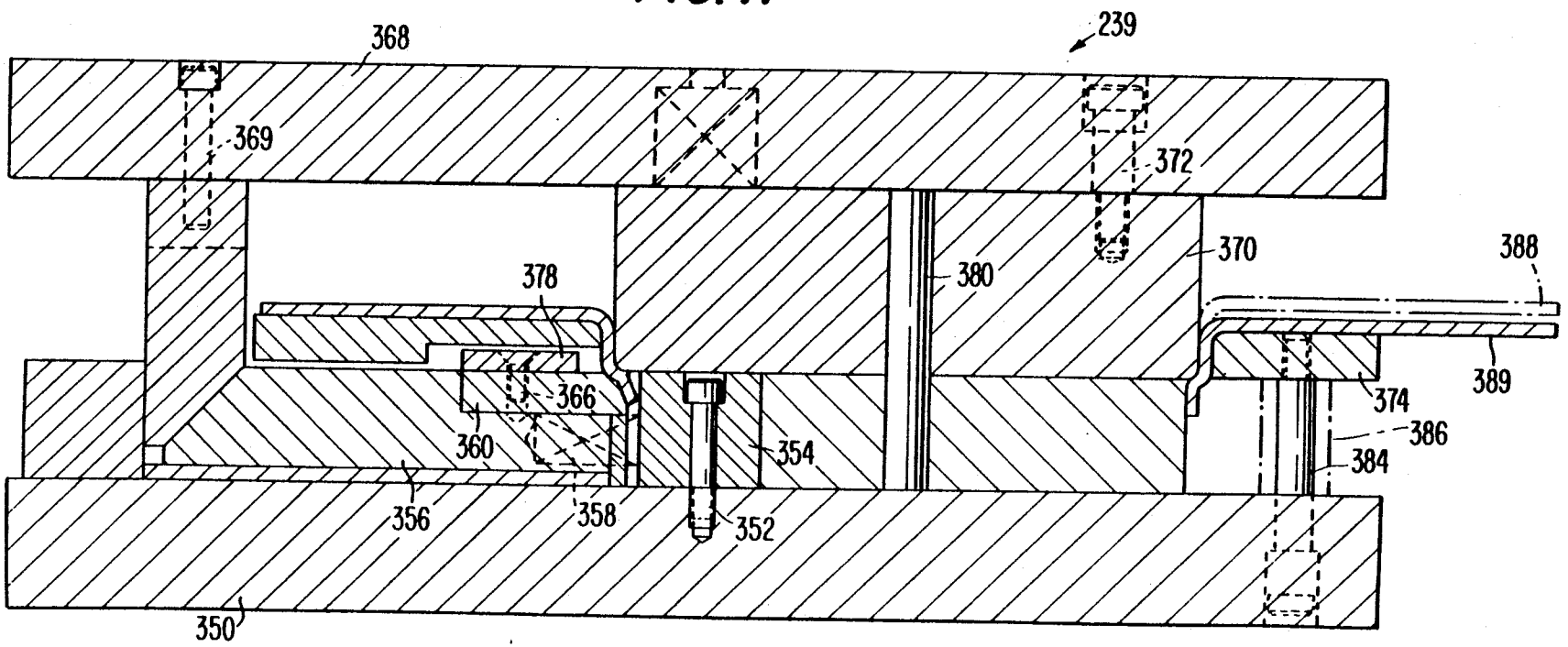
FIG. 11 is a sectional view of a fourth die of the present invention illustrating the keyway lance forming step.

(11) The keyway 238 is then formed in the die 239 of FIG. 11 using a one-hundred ton press.

Referring to FIG. 7, the construction and operation of the first die 222 will be explained. The flat metal piece 226 is located on the stop guides 240 of the lower press part. The upper press part includes the upper die set 241, the female draw die 242, the shim 243, the stripper plate 244 and the blank punch 245. The lower press part includes the lower spacer or shim 246, the lower die set or shoe 247, the draw punch 248, the mounting plate 249, the blank die 250 and the draw ring 256. The mounting plate 249 holds the blank die 250 in place. As the die is coming down, the stripper plate 244 is pushed out by springs so that it is at the level, at the bottom of the female draw die 242. As the upper part is pressed down by the press, the blank punch 245 pierces or cuts the center opening or hole, and punches out a round slug which drops down and out the bottom. As the draw is drawn down, the metal flows away from the center, away from the blank punch 248. As the die continues further down, it draws the Z-shaped cross-section, the preliminary sleeve draw 254, by pushing against the draw ring 256 and bottoming against the spacer 246. At that point, the die is working against the pressure from the press cushion through the pressure pin 260. When the press opens up, the pressure from the pins 260 raises the part up and moves it out to an accessible position. The stripper ring 244 strips it out of the top. The parallel member 264 positioned directly beneath the lower die set 240 raises it up so that the scrap can be removed.

The part 230 is removed from the first die 222 and turned upside down so that the "hat" is facing downward and placed in the second die 224 as depicted in FIG. 8. The upper part of this die is shown by the upper die set 270, a trim punch 272 secured thereto, an upper stripper plate 274 secured thereto by the shoulder screw 276 with a spring 278 disposed therebetween, and the return punch 280 secured to the upper die set by a shoulder screw 282. The part 230 is laid on the trim punch 272 and is in contact with the trim die. As the upper part is brought down, the teeth are cut by the trim punch 272 at the same time as the center hole is repierced. The upper stripper plate 274 strips it off. The hole is to be repierced, since after the hole is blanked in the die 222 of FIG. 7 and the draw 254 is made, the hole becomes larger or smaller depending upon the size of the draw. The deeper the draw, the larger the hole becomes. The holes are to be the same when the part is completed from the die 224 of FIG. 8 so that all parts will have the same extrusion or extrude length.

Although the teeth could be trimmed or cut after the flats 202, 204 have been coined, that would entail an additional operation. It is thus desirable to combine the teeth trimming with the repiercing in the same operation, as is done herein. The lower die set 290 comprises the plate member at the bottom of FIG. 8 and a shoulder screw 292 holds the mounting plate 294, spring 296, and stripper plate 298 to it. The trim punch 272 cuts the teeth forming a small piece of scrap 300. When the die 224 is opened, the stripper plate 298 shoves the scrap 300 upwards and strips it off. The stripper plate 298 is operated by the action of the spring 296. The screws 302 hold the trim punch 303 to the lower die set with the spacer plate 304 disposed therebetween, the spacer plate being made with inner and outer sections.

The disc part produced by the die of FIG. 8 is dropped into the coin and extrude die 220 of FIG. 9 and on the upper coin ring 312. The upper members of this die are the upper die set 310, an upper coin punch 316, a spacer 318 and a coin and extrude punch 320. A shoulder screw 322 holds the lower coin ring 324 to the mounting plate 326. The pressure pad 330 applies pressure to the part 234 and hold it. The coin and extrude punch 320 is spaced as needed by spacer 318 of the appropriate thickness depending on how deep the part is to be pushed, that is, the millimeter size being made. Thus, for the deepest part, the spacer 318 is needed and for the shallowest part it is not needed. As the upper part of the die comes down, it is coining the two flats 202, 204 at the same time while extruding the part to form the tip of the outer step 208. In other words, it is extruding the portion that fits around the shaft. The pressure pin 332 lifts the part out, after being formed, by applying pressure against the lifter plate or pad 334. The pressure pin 332, which is on a cushion, thus raises up and lifts the part out of the lower die part.

Especially for larger discs on the order of nineteen inches in diameter, the coining step of FIG. 9 makes the flange, or disc plate 210 of the disc bow upwards, like a dish or cymbal. The draw is deeper in the center and the plate flanges tend to bow upwards on the outside. This cupping is greater across the grain of the plate. This is undesirable and thus the flange or plate 210 is flattened in the die of FIG. 9 after the flats have been coined to within a few (six to fourteen) thousandths of an inch. The upper die set applies pressure to the upper form die 332 through the spring 300 with a spacer 334 disposed between the upper die set and the upper form die. The lower form die 336 is secured to the top of the mounting plate 338, which in turn is secured to the top of the lower die set 340. The lifter pads 334 are shown in two parts at the top of the pressure pin 332. FIG. 10 is basically the same as FIG. 9 except the upper form die 332 and the lower form die 336 have a one degree negative slope as shown by angle 342.

The flattened part is then removed from the die of FIG. 10 and subsequently placed in the die 239 of FIG. 11 to form the keyway 238. This die includes a lower die shoe 350 and secured thereto by a socket head cap screw 352 is the keyway die 354. The lower slide 356 is biased away from the keyway die 354 by a spring, 358, and the key punch 360 is secured to the lower slide by a flat head screw 366. A T-shaped cam 367 is secured to the underneath side of the upper die set 368 by a socket head cap screw 369. The pusher ring 370 is similarly secured to the underneath side by a shoulder screw 372, and pushes the part down against the lifter ring 374. As the upper die set 368 comes down, the cam 367 acts against the lower slide 356, pushing it inward, or to the right as shown in FIG. 11, against the bias of the spring 358. It thereby pushes the key punch 360 against the part, forming the keyway 238. In other words, the keyway punch 360 defines the keyway die male member and the female member is defined by the keyway die 354. The retainer plate 378 keeps the key punch 360 into the slide 356. The dowel pin 380 indicates the center line of the die 239. The lifter ring 374 is secured to the lower die shoe by shoulder screws 384, and raises the part up and down. When the part is dropped into the die, the ring 374 raises it up by the spring 386. This die can make different size parts. This flexibility is illustrated by the upper dotted line 388 which represents a ten millimeter part whereas the solid lines 389 show a seven millimeter part.

Figure 12:
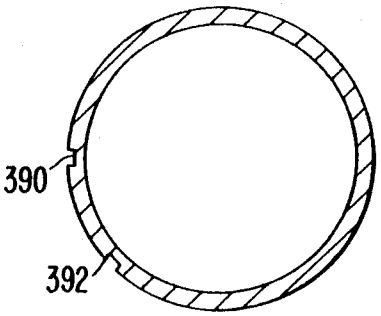
FIG. 12 is a cross-sectional view of the shaft tubing of the present invention, similar to that shown in FIG. 1 except having a pair of keyways provided.

It is desirable to stagger the teeth of adjacent discs on a shaft to help separate the matted material conveyed thereon. Thus the present invention provides for a pair of parallel longitudinal grooves 390, 392 formed on the shaft tube as shown in FIG. 12, and disposed at forty-five degrees relative to one another. The discs are slid onto the shaft with the keyways or dimples of adjacent discs being fitted alternatingly in the grooves. IFOs are between two and ten millimeters, where two is typical for fine screen and seven and a half for chip screen, and accuracies of ±0.020 (twenty thousandths) are obtainable with this invention, which meets the commercial demand requirements.

From the foregoing description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A disc screen assembly comprising:

a rotatable shaft having a shaft longitudinal axis;

a first disc assembly including a first toothed disc plate and a first collar extending out from said first toothed disc plate;

wherein said first collar includes a first outer step forming a first receiving sleeve through which said shaft receivably slides, a first inner step generally interconnecting said first outer step and said first toothed disc plate, a first shoulder at the transition between said first inner step and said first toothed disc plate, and a first stop at the transition between said first inner step and said first outer step;

wherein said first stop comprises a flat surface angled with respect to the shaft longitudinal axis;

a second disc assembly including a second toothed disc plate and a second collar extending out from said second toothed disc plate;

wherein said second collar includes a second outer step forming a second receiving sleeve through which said shaft receivably slides, a second inner step generally interconnecting said second outer step and said second toothed disc plate, a second shoulder at the transition between said second inner step and said second toothed disc plate, and a second stop at the transition between said second inner step and said second outer step;

wherein said second shoulder comprises a flat surface angled with respect to the shaft longitudinal axis; and clamping means for clamping said first and second disc assemblies together and on said shaft with said angled flat surfaces of said first stop and said second shoulder secured directly against one another to establish a desired spacing between said first and second toothed disc plates and to prevent relative wobble movement.

2. The disc screen assembly of claim 1 wherein said angled flat surfaces both have widths of one-quarter inch.

3. The disc screen assembly of claim 1 wherein said first stop and said first shoulder are simultaneously formed in a stamping procedure.

4. The disc screen assembly of claim 1 wherein said shaft has parallel longitudinal first and second grooves, said first collar receiving sleeve has a first anti-rotation key disposed in said first groove, and said second collar receiving sleeve has a second anti-rotation key disposed in said second groove.

5. A disc construction comprising:

a disc plate having outer peripheral teeth and first and second opposite plate faces; and a collar extending out from said first face;

wherein said collar includes an outer step forming a disc screen shaft sleeve means for slidingly receiving a disc screen rotation shaft, an inner step generally interconnecting said outer step and said disc plate, a shoulder at the transition between said inner step and said disc plate, and a stop at the transition between said inner and outer steps; and wherein said stop and said shoulder comprise, in longitudinal cross-section, parallel flat surfaces, each continuous with a different one of said opposite plate faces.

6. The disc construction of claim 5 wherein said shoulder and stop both comprise frusto-conical surfaces.

7. The disc construction of claim 5 wherein said shoulder and stop are formed as parallel rings.

8. The disc construction of claim 5 wherein said flat surfaces define forty-five degree angles with respect to a longitudinal axis of said sleeve means.

9. The disc construction of claim 5 wherein said shoulder and stop flat surfaces are simultaneously formed.

10. The disc construction of claim 5 wherein said collar comprises a hub having interior and exterior surfaces, said shoulder flat surface is on said hub interior surface and said stop flat surface is on said hub exterior surface.

11. The disc construction of claim 5 wherein said shoulder flat surface is formed in a coining procedure.

12. The disc construction of claim 5 wherein said stop flat is formed in a coining procedure.

13. The disc construction of claim 5 wherein said flat surfaces are stamped in a hydraulic press.

14. The disc construction of claim 5 wherein said flat surfaces have widths of generally between 3/16 and ¼ inch.

15. The disc construction of claim 5 wherein said flat surfaces have the same widths.

16. The disc construction of claim 5 wherein said disc plate and said collar are formed by die stamping a steel plate.

17. A disc construction comprising:

a disc plate having outer peripheral teeth and first and second plate faces; and a collar extending out from said first face;

wherein said collar includes an outer step forming a disc screen shaft sleeve means for slidingly receiving a disc screen rotation shaft, an inner step generally interconnecting said outer step and said disc plate, a shoulder at the transition between said inner step and said disc plate, and a stop at the transition between said inner and outer steps;

wherein said stop and said shoulder comprise, in longitudinal cross-section, parallel flat surfaces; and wherein said shoulder and said stop both comprise frusto-conical surfaces.

18. The disc construction of claim 17 wherein said first and second plate faces are on opposite sides of said disc plate.

19. The disc construction of claim 17 wherein said shoulder and stop flat surfaces are simultaneously formed in a coining procedure.

20. The disc construction of claim 17 wherein said stop forms an abutment surface, against which, with the disc screen rotation shaft received in said sleeve means, a corresponding shoulder of a similar adjacent disc construction on the shaft abuts.

21. The disc construction of claim 17 wherein said outer step and said inner step extend out perpendicular relative to said first face and parallel relative to the rotational axis of the disc screen rotation shaft.

22. A disc construction comprising:

a disc plate having outer peripheral teeth and first and second plate faces; and a collar extending out from said first face;

wherein said collar includes an outer step forming a disc screen shaft sleeve means for slidingly receiving a disc screen rotation shaft, an inner step generally interconnecting said outer step and said disc plate, a shoulder at the transition between said inner step and said disc plate, and a stop at the transition between said inner and outer steps;

wherein said stop and said shoulder comprise, in longitudinal cross-section, parallel flat surfaces; and wherein said flat surfaces define forty-five degree angles with respect to a longitudinal axis of said sleeve means.

23. The disc construction of claim 22 wherein said first and second plate faces are on opposite sides of said disc plate.

24. The disc construction of claim 22 wherein said shoulder and stop flat surfaces are simultaneously formed in a coining procedure.

25. The disc construction of claim 22 wherein said stop forms an abutment surface, against which, with the disc screen rotation shaft received in said sleeve means, a corresponding shoulder of a similar adjacent disc construction on the shaft abuts.

26. The disc construction of claim 22 wherein said outer step and said inner step extend out perpendicular relative to said first face and parallel relative to the rotational axis of the disc screen rotation shaft.

27. A disc construction comprising:

a disc plate having outer peripheral teeth and first and second plate faces; and a collar extending out from said first face;

wherein said collar includes an outer step forming a disc screen shaft sleeve means for slidingly receiving a disc screen rotation shaft, an inner step generally interconnecting said outer step and said disc plate, a shoulder at the transition between said inner step and said disc plate, and a stop at the transition between said inner and outer steps;

wherein said stop and said shoulder comprise, in longitudinal cross-section, parallel flat surfaces; and wherein said collar comprises a hub having interior and exterior surfaces, said shoulder flat surface is on said hub interior surface and said stop flat surface is on said hub exterior surface.

* * * * *